US005577723A

United States Patent [19]

DiResta et al.

[11] Patent Number: 5,577,723

[45] Date of Patent: Nov. 26, 1996

[54] SQUEEZABLE TOY BALL

[76] Inventors: Joseph G. DiResta; James DiResta, both of 1078 W. Broadway; Perry Gargano, 995 E. Broadway, all of Woodmere, N.Y. 11598

[21] Appl. No.: 543,615

[22] Filed: Oct. 16, 1995

[51] Int. Cl.[6] ..... A63B 41/00; A63H 3/26

[52] U.S. Cl. ..... 273/58 H; 273/58 BA; 273/58 E; 446/184; 446/188; 446/267

[58] Field of Search ..... 273/58 R, 58 B, 273/58 BA, 58 D, 28 E, 58 F, 58 G, 58 H, 58 K, DIG. 20; 446/184, 188, 267

[56] References Cited

U.S. PATENT DOCUMENTS

| | | | |
|---|---|---|---|
| 1,236,290 | 8/1917 | Griffen | 446/184 |
| 1,396,902 | 11/1921 | Wainola | 446/267 |
| 2,351,762 | 6/1944 | Hoover | 273/58 F |
| 4,917,645 | 4/1990 | Amici et al. | 446/184 |
| 4,986,540 | 1/1991 | Leslie | 273/58 H |
| 5,006,375 | 4/1991 | Mangan | 446/267 |
| 5,040,793 | 8/1991 | Chen | 273/58 BA |
| 5,329,714 | 7/1994 | Lee | 446/267 |

FOREIGN PATENT DOCUMENTS

| | | | |
|---|---|---|---|
| 743653 | 1/1956 | United Kingdom | 446/184 |

*Primary Examiner*—Steven B. Wong
*Attorney, Agent, or Firm*—Michael Ebert

[57] ABSTRACT

A squeezable toy ball which simulates a human organ such as the intestine, the ball when squeezed and released then generating a gurgling sound similar to that produced by a functioning intestine. The ball comprises a generally spherical outer shell formed of flexible plastic film encasing a hollow inner core. The core is molded of resilient plastic material to simulate the appearance of an intestine and is provided with an orifice which renders the hollow core collapsible. Injected into the core through the orifice is a charge of oil or other viscous liquid. When the ball is squeezed and deformed, oil and air are discharged from the orifice into the confined spaces between the core and shell, and when the ball is then released to recover its normal shape, oil and air are then sucked back into the shell, these actions producing a gurgling sound.

7 Claims, 1 Drawing Sheet

SQUEEZABLE TOY BALL

BACKGROUND OF INVENTION

1. Field of Invention

This invention relates generally to squeezable play balls which may be hit and thrown, and more particularly to a ball of this type which simulates the appearance of a human organ and which when squeezed generates a sound similar to that of a functioning organ.

2. Status of Prior Art

The patents to Osher et al. U.S. Pat. Nos. 5,026,054 and 4,944,363 disclose squeezable toy balls having a flexible polymer shell encasing a resiliently deformable inner core of highly plasticized material. Because of the highly plasticized nature of the polymeric core, the toy ball has a soft and supple resilient feeling to one who holds and squeezes it. According to these patents, the feel of the ball is both intriguing and relaxing.

It is also known to provide toy balls having a humanoid form. Thus the Tarnoff U.S. Pat. No. 4,952,190 shows a toy formed from a molded flexible bladder having a humanoid shape, the bladder being filled with a mixture of plastic microspheres and water so that the toy can be thrown or hit, yet can be caught with the bare hand. The rubber ball disclosed in the Johns U.S. Pat. No. 2,960,794 is molded to include pop out parts which when the ball is squeezed pop out to create facial features such as a nose and ears.

The concern of the present invention is with a squeezable ball which qualifies as a "gross" toy; that is a toy which may be disgusting. However, the fact that the toy may offend the taste of most adults does not detract from its appeal to children, for children are attracted to gross toys as they are to horror movies repugnant to many adults.

The psychological justification for a gross toy is the same as for many classic fairy tales, such as Little Red Riding Hood whose grandmother is devoured by a wolf. Horror movies and fairy tales make it possible for a child to vicariously experience the horrors of the real world and to prepare to cope with these horrors. And while the organs of a human body, such as the intestine and the brain are not playthings in the usual sense, they hold a fascination for children.

SUMMARY OF INVENTION

In view of the foregoing, the main object of this invention is to provide a "gross" toy in the form of a squeezable toy ball whose appearance simulate that of a human intestine or other human organ.

More particularly, an object of the invention is to provide a squeeze ball of the above type which can be hit or thrown like an ordinary ball, yet when squeezed generates a gurgling sound emulating that made by a functioning human intestine.

A significant feature of a "gross" toy, in accordance with the invention is that it is a realistic replica of a human organ which a child is able to view and manipulate and thereby gain an understanding of its purpose and function.

Also an object of this invention is to provide a squeezable toy ball which may be mass produced at low cost, the ball being sturdy and capable of withstanding rough handling.

Briefly stated, these objects are attained by a squeezable toy ball which simulates a human organ such as the intestine, and when squeezed then generates a gurgling sound similar to that produced by a functioning organ. The ball is formed from a liquid-impermeable outer shell of flexible plastic film material encasing a hollow inner core of resilient plastic material molded to simulate the appearance of the human organ, so that one is able to see and play with this organ.

The hollow core is provided with an orifice to render it collapsible. Injected into the core through the orifice is a charge of oil or other viscous liquid. When the ball is squeezed and deformed, oil and air are discharged from the orifice into the confined spaces between the core and casing, and when the ball is then released to recover its normal shape, oil and air are then sucked back into the casing, these actions producing a gurgling sound.

BRIEF DESCRIPTION OF DRAWING

For a better understanding of the invention reference is made to the detailed description to follow which is to be read in conjunction with the accompanying drawings of which.

DESCRIPTION OF INVENTION

Figure 1:
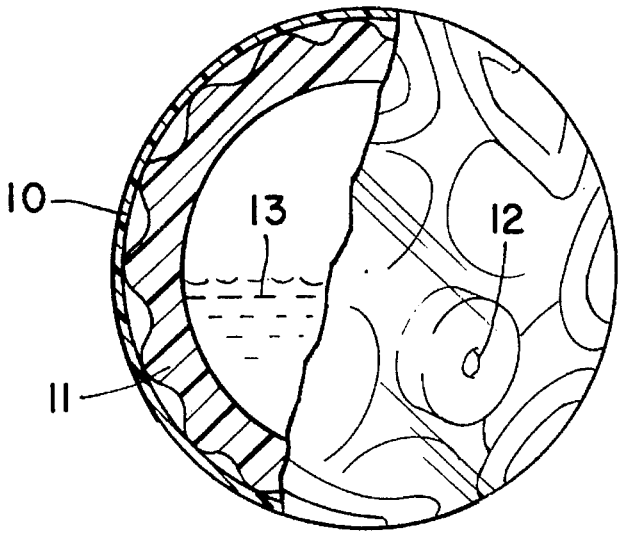
FIG. 1 shows a squeezable toy ball in accordance with the invention whose outer shell is cut away to expose the hollow inner core encased therein.

Referring now to FIG. 1, there is shown a "gross" toy in the form of a squeezable ball in accordance with the invention, the ball being formed by an outer shell 10 encasing a hollow collapsible inner core 11.

Outer shell 10 which is generally spherical, is formed by a transparent flexible film of synthetic plastic material of high strength and good clarity, such as silicon plastic, polypropylene or polyethylene, the shell being impermeable to liquids. Hollow inner core 11 is molded of resilient synthetic plastic material such as PVC. Core 11 is molded to simulate the appearance of a human intestine to provide a realistic replica thereof which is viewable through the transparent shell. The case material is dyed or pigmented to impart a blood-like veinous color thereto.

A human intestine is the mid and hind portion of the alimentary canal. It is formed by a long, more or less convoluted tube that is bunched. The intestine transports food material and digestive residues by means of muscular contractions, and it acts as a site for the digestive process which involves enzymes secreted by the mucous membrane which lines the walls of the intestinal tube. The digestive process which involves intestinal fluids produces gurgling sounds.

Figure 2:
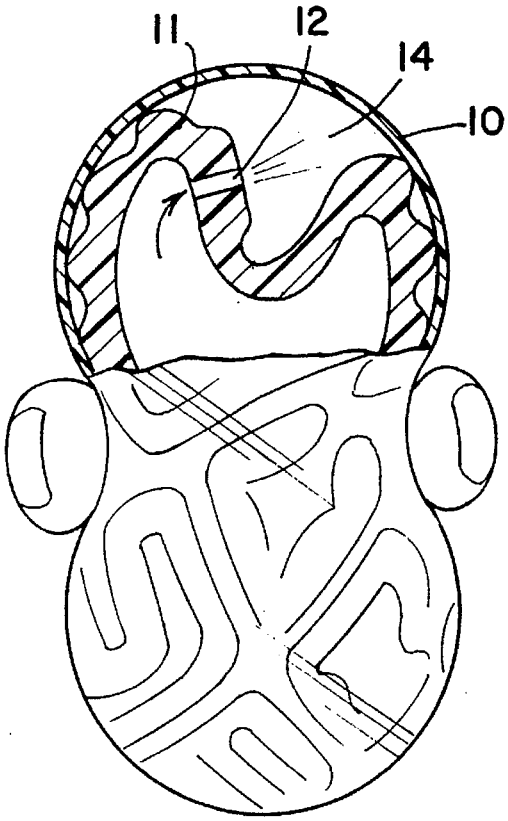
FIG. 2 shows the form of the ball when it is squeezed.

The distal opening of the alimentary canal is the anus, and as shown in FIGS. 1 and 2, the bunched alimentary canal which forms the intestine includes an anus opening 12 in a recessed portion of the hollow plastic core. Because of this opening, the hollow core 11 is collapsible, for when it is squeezed, the air confined within the core is ejected therefrom.

While the molded plastic mass which forms the replica of an intestine has recessed surfaces which define the convoluted tube of the intestine, the mass is somewhat spherical and occupies the interior of the spherical outer shell or casing 10. There are, however, free spaces between the outer casing and the inner core where the core is indented or recessed.

Injected into hollow core 11 through orifice 12 is a charge 13 of an inert viscous fluid, such as silicone or mineral oil. When, therefore, the ball is squeezed by a player and deformed, as shown in FIG. 2 the resultant internal pressure causes air and oil to be discharged of a spray 14 from orifice 12 into the confined space between the outer surface of the core and the inner surface of the casing. When the ball is released to recover its normal form, air and oil are then sucked back through the orifice into the hollow of the casing.

The discharge of air and oil from orifice 12 produces gurgling sounds, these sounds also being produced when air and oil are sucked back into the hollow of the core. These sounds are similar to these produced by a functioning of natural intestine.

One who plays with this squeezable ball by throwing it and catching it, in effect is using a human organ as a ball. There is some historic precedent for this play activity, for the Aztec Indians were known to use human skulls as playballs, presumably the skulls of their enemies.

Hence the ball qualifies as a "gross" or horror toy. But it is more than just that, for the replica of the intestine is realistic and gives the child playing with it an appreciation of the structure and function of this extraordinary human organ.

The cerebral cortex of the brain formed of gray matter in the cerebral hemisphere has a convoluted form somewhat similar in appearance to an intestine. Core 11 may therefore be molded and colored to simulate the cerebral cortex. Or the core may be molded to provide a hollow resilient plastic replica of the pancreas or other organs or parts of the human body.

While there have been shown preferred embodiments of a squeezable toy ball in accordance with the invention, it will be appreciated that many changes may be made therein without departing from the spirit of the invention.

What is claimed:

1. A "gross" toy in the form of a squeezable play ball comprising:

A. generally spherical liquid-impermeable outer shell formed of transparent flexible plastic film material;

B. a collapsible hollow core encased within the shell molded of resilient plastic material and shaped to simulate a human organ, or body part, said core being provided with an orifice to render it collapsible whereby when the playball is squeezed to deform the core, air within the hollow core is discharged through the orifice into a space between the core and the shell encasing the core and when the deformed core resumes its normal shape, the air in the space is sucked back into the core; and C. a charge of viscous liquid injected into the core through the orifice whereby when the ball is squeezed to deform it and then released so that it resumes its normal shape, air and said liquid are then discharged through the orifice into the space between the core and shell to produce a gurgling sound.

2. A toy as set forth in claim 1, in which the molded core resembles an intestine, and said orifice resembles the anus of the intestine.

3. A toy as set forth in claim 2, in which the core is pigmented to impart blood-like veins thereto.

4. A toy as set forth in claim 1, in which the liquid is silicone oil.

5. A toy as set forth in claim 1, in which the liquid is mineral oil.

6. A toy as set forth, in claim 1, in which the shell is formed of polypropylene.

7. A toy as set forth in claim 1, in which the core is molded of polyurethane.

* * * * *